US005284291A

United States Patent [19]

Sellors

[11] Patent Number: 5,284,291

[45] Date of Patent: Feb. 8, 1994

[54] MULTI-COMPARTMENT CARTON

[75] Inventor: Thomas J. Sellors, Winthrop Harbor, Ill.

[73] Assignee: Olympic Packaging, Inc., Mundelein, Ill.

[21] Appl. No.: 936,574

[22] Filed: Aug. 27, 1992

[51] Int. Cl.[5] ..... B65D 5/48

[52] U.S. Cl. ..... 229/120.03; 229/120.18; 229/242

[58] Field of Search ..... 229/120.03, 120.11, 229/120.18, 120.29, 240-242; 206/315.9

[56] References Cited

U.S. PATENT DOCUMENTS

| | | | |
|---|---|---|---|
| 2,888,185 | 5/1959 | Porter | 229/120.18 |
| 2,965,278 | 12/1960 | Phillips | 229/120.29 |
| 2,973,130 | 2/1961 | Cottrill | 229/120.18 |
| 3,326,444 | 6/1967 | Farquhar et al. | 229/120.18 |
| 3,682,297 | 8/1972 | Austin et al. | 229/120.18 |
| 4,294,397 | 10/1981 | Kohler | 229/120.29 |
| 4,318,470 | 3/1982 | Montealegre | 229/120.29 |
| 4,541,560 | 9/1985 | Fischer | 229/120.29 |
| 5,044,548 | 9/1991 | Olsen et al. | 229/120.03 |

FOREIGN PATENT DOCUMENTS

| | | | |
|---|---|---|---|
| 200130 | 11/1955 | Australia | 229/120.11 |
| 753118 | 2/1967 | Canada . | |
| 2573726 | 5/1986 | France | 229/120.18 |

*Primary Examiner*—Gary E. Elkins
*Attorney, Agent, or Firm*—Foley & Lardner

[57] ABSTRACT

A multi-compartment carton which may be used for such applications as packaging golf balls or other products, is made from a single blank of folding carton stock. The blank is slotted, scored and perforated to form a variety of panels and flaps. In the preferred embodiment, the carton includes four elongate sleeves for containing golf balls, and the blank is constructed in such a manner that two initial glue lines form a double undivided sleeve and a single sleeve. The product resulting from that operation is folded along another score line to form an intermediate carton having two adjacent, separated elongate sleeves and a double, undivided sleeve. The fourth sleeve is created by folding a flap and gluing it to a panel, one side of the flap forming the divider and the third and fourth sleeves. Preferred arrangements for closing the ends of the carton are illustrated, including a perforated arrangement to permit opening one compartment at a time.

7 Claims, 3 Drawing Sheets

MULTI-COMPARTMENT CARTON

Cross-References To Related Applications, If Any: None.

BACKGROUND OF THE INVENTION

1. Field of the Invention

The present invention relates to the field of folding cartons, and more specifically, to a multi-compartment folding carton which may be made from a single blank of folding carton stock. In the most preferred embodiment, the present invention relates to a folding carton including four compartments, each generally square in cross-section, suitable for packaging a plurality of articles, such as golf balls.

2. Description of the Prior Art

Numerous containers are known in the art for packaging multiple products, such as golf balls. One such product is disclosed in Olson, et al. U.S. Pat. No. 5,044,548 issued Sep. 3, 1991 and entitled "Stacking Ball Carton, Blank And Method". The carton described in this patent is adapted for holding golf balls in four stacks of three each, and is designed to replace the more well-known system of individual sleeves of three balls contained in a covered tray. The prior conventional package causes considerable waste of board resulting in increased manufacturing costs and, in these days of environmental concerns, the utilization of more board than is required to adequately package the product. In the Olson, et al. carton, complicated strut and panel structures are provided and the initial set-up of the carton begins by folding the panels and struts and gluing them in such a way that two undivided sleeves are formed. Utilizing a series of cutouts and additional folds, the two halves of the partially set-up carton are then folded along a score line, and flaps pass through openings to provide dividers between the individual sleeve areas to form four elongate compartments. The patent also describes several closure techniques and providing windows at one or more areas of the carton so that a user can see the contents.

While the Olson, et al. container provides a multi-compartment chamber suitable for packaging objects such as golf balls, it suffers from several disadvantages in connection with the preparation of the initial blank and in connection with the set-up of the carton itself. The intricacies of the set-up operation are readily appreciated by reference to FIGS. 4–8 of that patent. Moreover, the relatively narrow glue areas do not provide a device with suitable structural rigidity, and the dividers themselves are not full-length and uninterrupted as would be desirable for some applications.

Several other multi-compartment cartons are described in other patents. For example, see Hennessey Canadian Patent No. 753,118 issued Feb. 21, 1967 and entitled "Compartmented Carton". This device is a three compartment carton prepared from a single blank. Note also the "Compartmental Box" described in Porter U.S. Pat. No. 2,888,185 issued May 26, 1959.

Based on the foregoing description of certain prior art patents, it can be readily appreciated that while multi-compartment cartons are known, the need exists for compartmentalized cartons which are easy to assemble and which use a minimum amount of board. Moreover, the need exists for multi-compartment cartons wherein the dividers for the compartments extend substantially the length of the carton to provide structural integrity for the final assembled carton. Furthermore, the need exists for multi-compartment cartons which can be adapted to a variety of products.

SUMMARY OF THE INVENTION

How the present invention overcomes the drawbacks of the prior art will become apparent after the following specification, taken in conjunction with the drawings, has been reviewed. The present invention features a blank for preparing a multi-compartment carton which is integral and which minimizes board consumption.

The present invention also features a blank which is cut, scored and perforated to provide for easy set-up in three basic operations which will be illustrated in the FIGURES.

The present invention further features a carton design which may be readily adapted to products of different shapes and sizes.

The present invention also features a folding carton which is strong and which may be utilized with a variety of closure systems, some of which, in and of themselves, have been used with other carton designs.

Further features of the invention will become apparent to those skilled in the art after reading the present specification and such features are deemed to fall within the scope of the invention if they fall within the scope of the claims which follow.

In its most preferred form, the present invention features an elongate blank of folding carton stock which includes a variety of closure panels along opposed edges and a series of adjacent panels and score lines along the long dimension of the blank, all arranged to form the multiple compartments of the final product. The panels include three adjoining full-length and full-width panels for forming three sides of the final carton, a half-width, full-length panel disposed on either end of the full length and width panels, another full-width and full-length panel adjacent one of the half panels, the last mentioned panel including a flap, a half-width and partial length panel adjacent the other of the half-width panels and glue flaps at either end of the blank. The carton is assembled by first folding and gluing one of the end flaps to the mid-point of the center full-length and full-width panel, thereby forming a full-length and half-width compartment which will subsequently be divided into two compartments. The next step is to fold the opposite glue flap and attach it to the mid-line of its adjacent full-length and full-width panel to form one of the final compartments of the carton. Folding of the two partially completed sections along the score line nearest the last mentioned glue line between adjacent full-length and full-width panels forms a nearly completed carton having two fully formed compartments. The carton set-up is completed by folding the flap and gluing it to the half-width, partial length panel to subdivide the undivided compartment into the final two compartments.

Ways in which the features of the invention may be modified to result in cartons having different shapes and sizes, e.g. to accommodate products of different shapes and sizes, will become readily apparent to those skilled in the art after reading the following detailed description and reviewing the drawings. Such ways are also deemed to fall within the scope of the invention if they fall within the scope of the claims which follow.

DETAILED DESCRIPTION OF THE DRAWINGS

In the various FIGURES, like reference numerals are used to illustrate like components.

DETAILED DESCRIPTION OF THE PREFERRED EMBODIMENT

Before proceeding to the detailed description of the most preferred embodiment and the accompanying FIGURES, several comments are in order regarding the scope and applicability of the carton of the present invention. The application as shown in the FIGURES is a golf-ball carton, sized to contain four (4) golf balls within each of four (4) compartments. The FIGURES also show several features which are relatively standard in the golf ball packaging field, such as transparent panels so that the user may see the carton contents. Furthermore, the various techniques used to seal the bottom and the top of the carton do not, in and of themselves, form part of the present invention, and are shown in the FIGURES in a preferred form. The closure techniques could be widely varied, as is known in the folding carton trade.

The size of the carton could also be varied to accommodate, for example, twelve golf balls instead of the illustrated sixteen. Other products, such as tennis or ping-pong balls could also be packaged using the carton of the present invention. Furthermore, the multi-compartment cartons could be used in a wider range of applications than just for sporting equipment, such as for cosmetics, paints, or any other application where a manufacturer would desire to sell its product in separated compartments or where, for example, it is desirable to have several ingredients of a final product packaged separately in a single carton, e.g. automotive or even food products.

The material used to construct the carton of the preferred embodiment is a foil coated, bleached folding carton stock. However, other types of carton stock could be employed, including pre-printed stock, recycled materials and the like. It is certainly not necessary to provide foil on the exterior of the carton. In that connection, the illustrations shows certain treatment of the foil in areas which will receive glue during set-up of the carton, a feature which again is for purposes of illustration only.

Furthermore, the present invention could be adapted by one skilled in the art to cartons containing more than four compartments, such as cartons with six or eight compartments. Moreover, one of the panels in the illustrated embodiment is slotted to permit ease of loading the finished product, in this case golf balls. That slot need not be employed either for golf balls or for other applications. Finally, while the use of one or more transparent panels is preferred, those openings can be eliminated or varied in shape.

Figure 1:
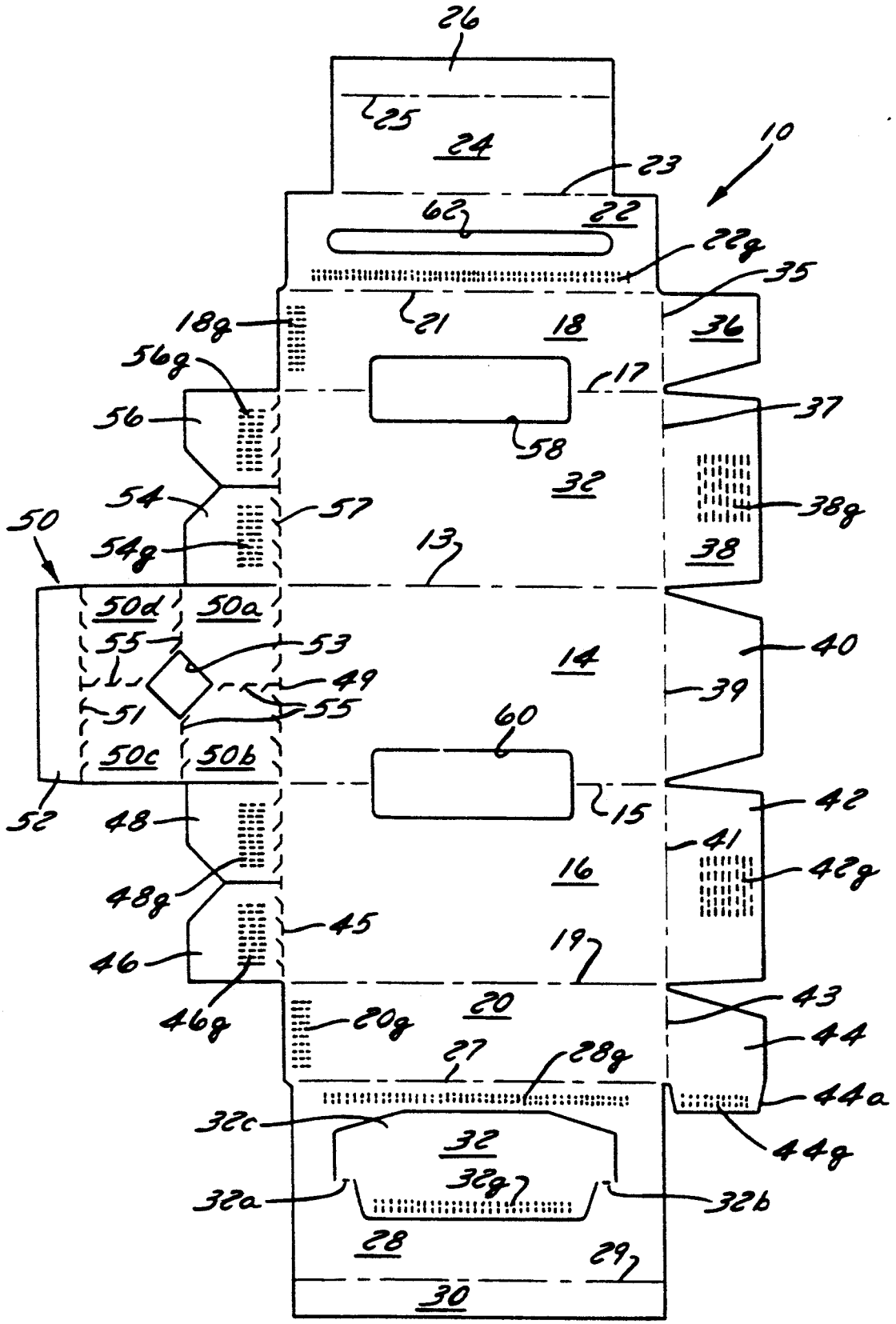
FIG. 1 is a top elevational view of the carton blank used to prepare the multi-compartment carton representing the most preferred form of the present invention.

Proceeding now to a description of FIG. 1, a blank 10 used to form the carton of the preferred embodiment of the invention is shown in an elevational view, with the foil side of the folding carton stock facing upwardly. Cut lines between adjacent panels are shown in the illustrations as solid lines. Score lines are shown as broken lines and certain perforated lines are shown in broken lines having generally L-shaped extensions thereto. Certain areas in the preferred embodiment have been roughened, indicated by a dotted pattern, to provide a more respective surface for glue during formation of the final product.

Blank 10 is divided into ten adjacent panels down its center, each joined to the other by a score line. These panels (12, 14, 16, 18, 20, 22, 24, 26, 28 and 30) will eventually form the four compartments of the illustrated, preferred embodiments. Blank 10 also includes eleven (11) closure panels (36, 38, 40, 42, 44, 46, 48, 50, 52, 54 and 56) which extend outwardly from the sides of certain of the previously mentioned panels, all of the latter being part of the previously mentioned panels, systems. Each of the twenty-one panels, as well as a flap 32 will be described in detail.

Proceeding first to a description of the ten panels forming the longer dimension of blank 10, they include three full-length and full-width panels 12, 14, and 16 adjoining one another. A score line 13 joins panels 12 and 14 and a score line 15 joins panels 14 and 16. By full-length and full-width, as used in the specification, it is meant that such panels are as long as the final carton and are as wide as a side of the final carton.

A full-length, half-width panel 18 is attached to panel 12 by score line 17 and a similar full-length half-width panel 20 is attached to panel 16 by score line 19. Another half-width and generally full-length panel 22 is attached to panel 18 by score line 21. A half-width, partial-length panel 24 is joined to panel 22 along score line 23 and a glue flap 26 is attached to panel 24 along score line 25. At the opposite end of the blank 10, a full-length and full-width panel 28 is joined to panel 20 by a score line 27 and a full-length glue flap 30 is joined to panel 28 by a score line 29.

The way in which previously described flaps and panels are folded and assembled into the product of the present invention will be described following the ensuing description of the closure panels.

In connection with the closure panels, the first ones to be described will be panel 36–44, which will eventually form the carton bottom. Panel 36 is coupled to panel 18 along a score line 35 and is a truncated rectangular panel. Panel 38 is coupled to panel 12 along score line 37 and is generally rectangular in configuration. Panel 40 is coupled to panel 14 along score line 39 and is truncated on its sides. Panel 42, which is similar to panel 38, is joined to panel 16 along score line 41 while panel 44 is joined to panel 20 along score line 43. Panel 44 includes a die cut area adjacent panel 42 and a small extension tab **44*a* extending away from panel 42**.

Proceeding now to the closure elements on the opposite side of blank 10, a pair of individual closure flaps 46 and 48 are joined to panel 16 along a perforated line 45.

A larger flap 50 is coupled to panel 14, panel 50 being generally square in configuration and being coupled to panel 14 along another perforated line 49. A glue flap 52 is provided on the edge of panel 50 opposite panel 14 and is joined to the remainder of panel 50 along a perforated line 51. Panel 50 also includes a central rectangular aperture 53 and from each corner thereof, a perforated line 55 extends to the midpoint of one of the sides of panel 50, thus dividing panel 50 into four attached subpanels 50*a*, 50*b*, 50*c* and 50*d*.

The final two closure panels 54 and 56, being in all respects similar to panels 46 and 48, are joined to panel 12 along perforated line 57.

Several additional features of blank 10 need to be described before proceeding to a description of the formation of the carton of the most preferred embodiment of the present invention. Most prominent are two rectangular apertures 58 and 60 formed at the midpoint of score lines 17 and 15, respectively, aperture 58 being cut from panels 18 and 12 while aperture 60 is cut from panels 14 and 16.

Another opening is provided in blank 10, this one being an elongate slot 62 formed along the centerline of panel 22 but spaced inwardly of the ends of panel 22.

Finally, in connection with blank 10, there are fourteen areas which are provided with texturing to improve adhesion between the foil surface and the surface to which the area will be attached, such texturing being represented in the figures by a dotted line pattern. In practice, with a foil surface, the blank would be textured by numerous slices each extending partially through the carton stock, i.e., at least through the foil layer, to provide a surface which is more receptive to glue penetration than would otherwise be possible. As mentioned previously, if the foil is eliminated, these particular elements could be eliminated.

The glue areas are identified in the drawing by reference to the panel number on which they exist as well as by the addition of the letter "g" to the panel number. Furthermore, for reference purposes, the left side of FIG. 10 will be referred to as the top side since the closure elements thereon will form the top of the carton of the preferred form of the invention, while the right side will be referred to as the bottom side. In that regard, glue areas are formed at the top side of panels 18 and 20, as well as on panels 22 and 28. Glue area 22*g* is located between slot 62 and score line 21, while glue line 28*g* is located between flap 32 and score line 27. The flap itself includes a glue area 32*g* along the edge of the flag nearest score line 29.

In connection with the bottom closure elements, glue areas are formed on panels 38 and 42 as 38*g* and 42*g* respectively, and along the extension 44*a* of panel 44 as 44*g*. With regard to the top closure members, glue areas are formed on each of panels 46, 48, 54 and 56 as 46*g*, 48*g*, 54*g* and 56*g*, respectively.

Now that all of the physical components of blank 10 have been described, a few additional comments will help one skilled in the art understand the particular arrangements of several of the components. For example, a diagonally cut area is removed from each of panels 46, 48, 54 and 56 so that when the carton of the preferred embodiment is assembled a square aperture, identical in size to aperture 53, will be formed below panel 50. The reasons for this arrangement will become apparent as the description continues. Also, in connection with the shape of flap 32, the solid lines illustrated in FIG. 1 define cut portions, but it should be noted that a score area exists at the top and bottom end of flap 32 represented respectively as areas 32*a* and 32*b*. These portions should be long enough to allow the flap to be folded along the line defined by portions 32*a* and 32*b* without tearing, as again will become apparent as the descriptions continue.

Figure 2:
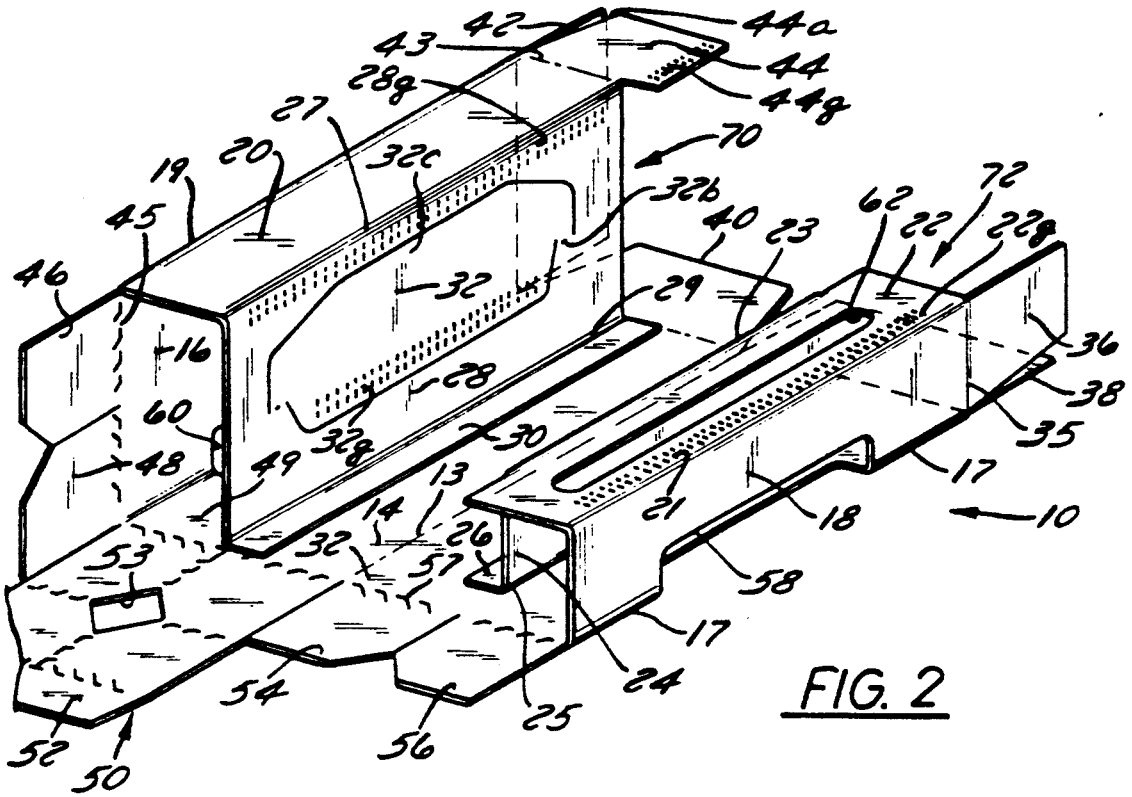
FIG. 2 is the first in a sequence of three FIGURES showing the initial step in the formation of the multi-compartment carton of the present invention.

Proceeding now to a description of FIG. 2, the first two steps in the assembly of the carton of the preferred form of the invention are illustrated. Each step involves the folding of blank 10 along several of the score lines and the conducting of two gluing operations. These will be described in a particular sequence, but obviously the sequence could be reversed or the folding and gluing steps could be accomplished simultaneously.

To form the partially completed carton illustrated in FIG. 2, panel 16 and its attached end closure panels is folded along score line 15 so that panel 16 is perpendicular to panel 14. Panel 20 is folded along score line 19 so that it is parallel to panel 14 and panel 28 is folded along score line 27 so that it is parallel to panel 16 and perpendicular to panel 14. The glue flap 30 is folded along score line 29 in an outward direction, away from panel 16, so that it adjoins panel 14. It should be noted that score line 29, at this point, is adjacent to the centerline of panel 14. Addition of adhesive between flap 30 and panel 14 will form the partially completed compartment 70 illustrated at the left hand side of FIG. 2.

A single compartment 72 is formed on the right side of the partially completed carton shown in FIG. 2 by first folding panel 18 along score line 17 so that it is perpendicular to panel 12. Panel 22 is then folded along score line 21 so that it is perpendicular to panel 18 and parallel to panel 12. Panel 24 is then folded downwardly so that it is perpendicular to panel 12 and parallel to panel 18, while flap 26 is folded outwardly so that it is adjacent to panel 12. Gluing panel 26 to panel 12 so that score line 25 extends along the longitudinal centerline of panel 12 completes the formation of the single compartment 72. At this point in the construction, all gluing has been accomplished on the paper surface of the carton stock so none of the roughened glue areas have been involved to this point.

Figure 3:
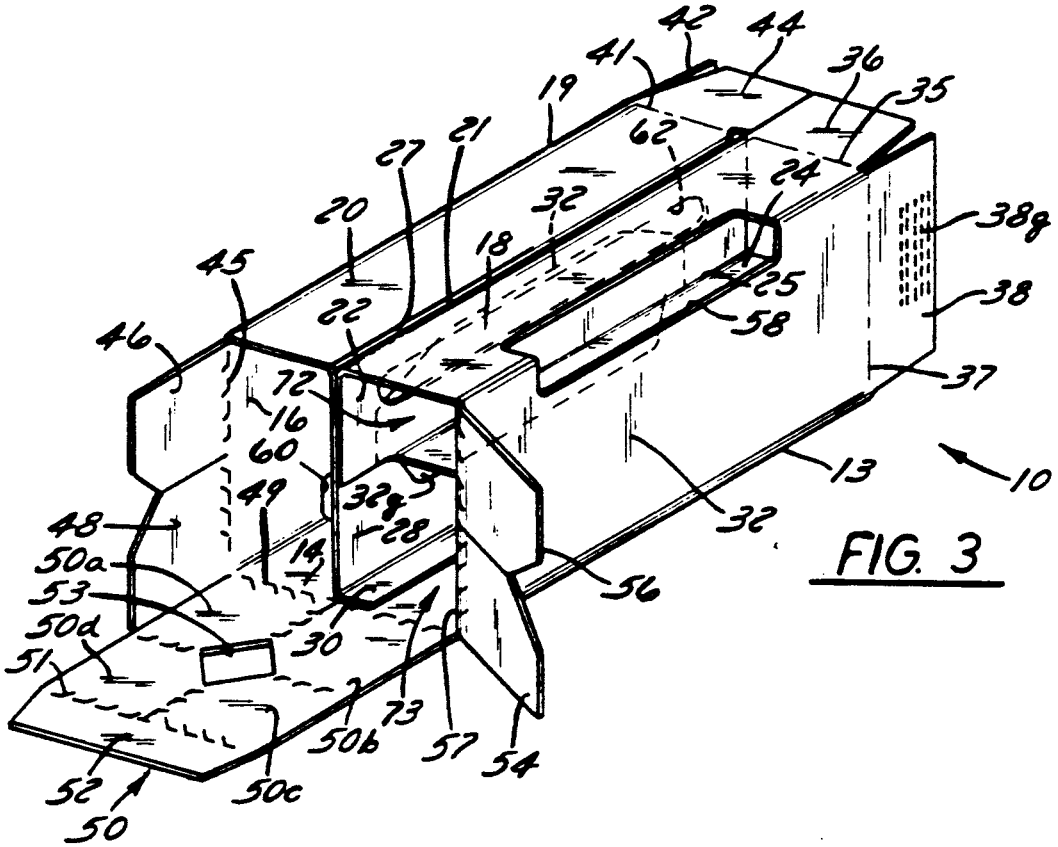
FIG. 3 is another and subsequent FIGURE in the sequence showing the configuration of the preferred embodiment of the present invention prior to performing the flap fold and glue operation.

The next step in the assembly of the carton of the carton of the preferred form of the invention is illustrated in FIG. 3. This partially completed carton is formed by folding panel 12 to a vertical position along score line 13 and by gluing the two glue areas 22*g* and 28*g* to each other. Closure panels 54 and 56 have been bent out of the way for purposes of this illustration to show the internal construction resulting from the folding and gluing operations. Note particularly the orientation of panel 24 as being perpendicular to panel 28, while panel 22 confronts and is secured to panel 28. Flap 32 remains in its initial orientation and this stage of the assembly process. It is shown in dashed line in this FIGURE. Note also that in the partially completed carton shown in FIG. 3 two of the multi-compartments (72 and 73) have been formed on the right side of the FIGURE as viewed from the top, while a double size, undivided compartment 70 remains on the left side.

It can also be noted in FIG. 3 that portion 44*a* of panel 44 now rests beneath panel 36 and may be glued thereto at this time or in the subsequent closure operations.

Figure 4:
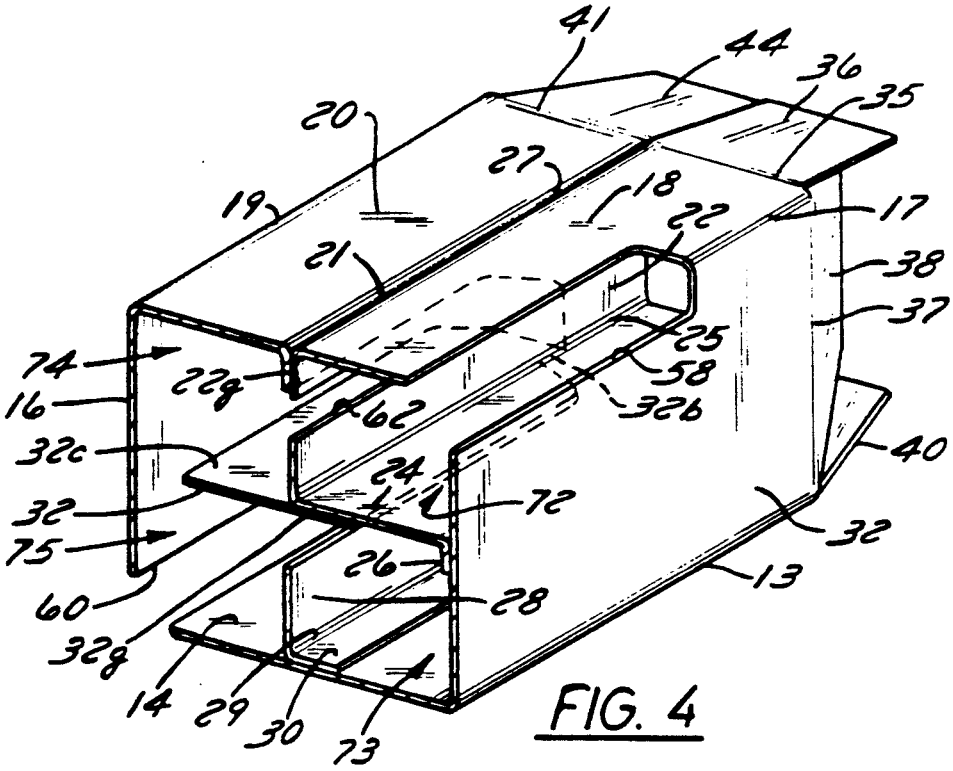
FIG. 4 is another and subsequent FIGURE in the sequence, showing the flap folded and glued to form four compartments in the multi-compartment carton of the preferred embodiment of the present invention.

Proceeding now to FIG. 4, a partial view of the bottom end of the carton of the preferred embodiment of the invention, it can be seen that flap 32 has been rotated 90 degrees along portions 32*a* and 32*b* and that glue line 32*g* has been glued to the underside of panel 24. The larger portion of the flap represented by reference numeral 32*c* extends toward but does not contact panel 16, thus dividing the double size compartment at the left of the FIGURE into two additional ones (74 and 75) of the multi-compartments of the final product. At this stage, four equally sized, elongate, square compartments have been formed.

Figure 5:
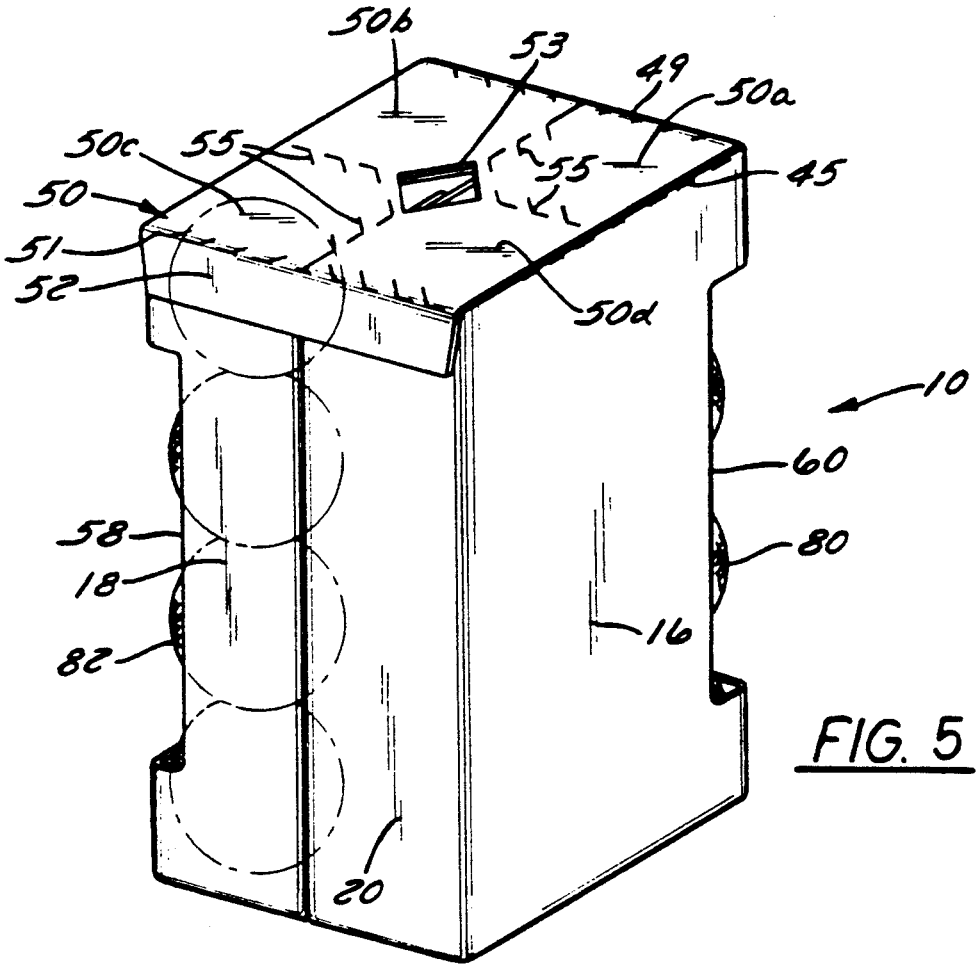
FIG. 5 is a perspective view of a golf ball carton prepared according to the preferred form of the invention, showing the closure panels sealed.

The carton 80 of the preferred form of the present invention is illustrated in FIG. 5, where the end closures have been made. The bottom closures have not been illustrated in great detail because it will be obvious to those skilled in this art that application of glue to the glue areas 38*g*, 42*g* and 44*g* and folding of panels 36, 38, 40, 42 and 44 will result in a complete closure of the bottom of this container.

The upper closure is shown in greater detail where flap 52 is folded along perforated line 51 and is adhered to the glue areas 18*g* and 20*g* on panels 18 and 20, respectively. Prior to that step, the four closure panels 46, 48, 54 and 56 have glue applied thereto so that the foil coated side of blank 10 can adhere to the paper surface of panel 50. The aperture 53 and the layers of the last mentioned panels are shown in FIG. 5 and it will be appreciated from this FIGURE that to open any of the individual compartments, one need merely insert a finger and lift toward a corner to remove a portion of panel 50 as well as the underlying closure panel.

Also apparent from FIG. 5 are the golf balls 82 which have been loaded into carton 80 prior to closure. As mentioned previously, the number in each compartment can vary. In addition, openings 58 and 60 are shown in this FIGURE. In the golf ball art, it is known to provide a clear resin film over apertures 58 and 60 (not shown in these drawings), but which procedure, in and of itself, is well known.

To this point in the description, no further references have been made to slot 62 in panel 22. However, it has been found that in automatic loading equipment, such slot permits improved speed for the round golf balls shown in this application.

While one particular embodiment has been illustrated, one skilled in the art could readily adapt the principles of the invention, particularly the step of folding a flap to provide an additional divider between compartments, for other products, sizes and materials. Reference should be made to the claims which follow to determine the scope of the present invention.

What is claimed is:

1. An elongate blank for forming a multi-compartment folding carton, the blank comprising a plurality of panels hingedly coupled by score lines, the panels including three adjoining full-length and full-width side wall panels for forming three sides of the carton, first and second full-length and half-width panels on either end of the side wall panels, a further full-length and full-width panel adjoining the first of the half-width panels, the further full-length, full-width panel including a flap cut therein, a pair of aligned score lines at opposite ends of the flap whereby the flap may be foiled 90° with respect to said further panel along the aligned score lines and so that a first portion of the flap extends perpendicularly to one side of this further panel and so that a second portion of the flap extends perpendicularly to the other side of this further panel, a further full-length half-width panel adjoining the second full-length, half-width panels, a half-width, partial-length panel adjoining the further full-length, half-width panel, a glue flap panel at either end of the blank and closure elements along the sides of the blank.

2. The blank of claim 1 wherein the first portion of the flap is approximately half as wide as the full-length, full-width panels.

3. The blank of claim 2 wherein the second portion of the flap is narrower than the first portion.

4. The blank of claim 1 wherein the further full-length, half-width panel includes an elongate slot between the ends of this panel.

5. The blank of claim 1 wherein the glue flap panels are narrower than the half-width panels.

6. The blank of claim 1 wherein the closure elements include elements arranged to permit closure of one compartment at a time.

7. The blank of claim 1 wherein the blank also includes a rectangular opening interrupting the score line joining two of the side panels, and a rectangular opening interrupting the score line joining the third of the side wall panels and the full-length, half-width panel adjoining the third side panel.

* * * * *